US011793236B2

(12) United States Patent
Tan

(10) Patent No.: US 11,793,236 B2
(45) Date of Patent: Oct. 24, 2023

(54) ELECTRONIC CIGARETTE CARTRIDGE DUAL-SEAL REVERSE PRESSURE DIFFERENTIAL LIQUID INJECTION METHOD AND ELECTRONIC CIGARETTE CARTRIDGE USING THE METHOD FOR INJECTING LIQUID

(71) Applicant: SHENZHEN INNOKIN TECHNOLOGY CO., LTD., Guangdong (CN)

(72) Inventor: Huimin Tan, Shenzhen (CN)

(73) Assignee: SHENZHEN INNOKIN TECHNOLOGY CO., LTD., Shenzhen (CN)

( * ) Notice: Subject to any disclaimer, the term of this patent is extended or adjusted under 35 U.S.C. 154(b) by 1001 days.

(21) Appl. No.: 16/697,562

(22) Filed: Nov. 27, 2019

(65) Prior Publication Data

US 2020/0170305 A1 Jun. 4, 2020

(30) Foreign Application Priority Data

Nov. 29, 2018 (CN) ..... 201811443482.2

(51) Int. Cl.
*A24F 40/42* (2020.01)

(52) U.S. Cl.
CPC ..... *A24F 40/42* (2020.01)

(58) Field of Classification Search
CPC ..... A24F 40/42; A24F 40/10; A24F 47/00; B65B 3/003; B65B 5/045; B65B 7/2821; B65B 7/2828; B65B 7/285; B65B 31/00
See application file for complete search history.

(56) References Cited

U.S. PATENT DOCUMENTS

| | | | | |
|---|---|---|---|---|
| 9,986,769 | B1 * | 6/2018 | Liu | A24F 40/40 |
| 10,188,148 | B2 * | 1/2019 | Althorpe | A24F 40/40 |
| 2017/0045994 | A1 * | 2/2017 | Murison | H02J 7/342 |
| 2017/0064997 | A1 * | 3/2017 | Murison | H02J 7/0044 |

* cited by examiner

*Primary Examiner* — Jean F Duverne
(74) *Attorney, Agent, or Firm* — MILLBURN IP PLLC

(57) ABSTRACT

The present disclosure provides a dual-seal reverse pressure differential cartridge E-liquid injection method. The method includes: selecting an E-liquid guiding body configured to absorb, to a maximum degree, an E-liquid stored in an E-liquid storage tank, to avoid leakage of the E-liquid, while providing a smooth supply of the E-liquid. The method also includes assembling the E-liquid guiding body with a cartridge that includes an E-liquid storage tank. The E-liquid guiding body is in fluidic communication with the E-liquid in the E-liquid storage tank. In a negative pressure environment, the E-liquid is injected into the E-liquid storage tank. The E-liquid has a pressure P1. After the injection is completed, the cartridge is placed in a sealing bag, which is then sealed. The pressure inside the sealing bag is P2, P2>P1. The disclosed method can effectively avoid leakage of the E-liquid due to pressure changes in the external atmosphere.

20 Claims, 6 Drawing Sheets

ELECTRONIC CIGARETTE CARTRIDGE DUAL-SEAL REVERSE PRESSURE DIFFERENTIAL LIQUID INJECTION METHOD AND ELECTRONIC CIGARETTE CARTRIDGE USING THE METHOD FOR INJECTING LIQUID

This patent application claims priority to Chinese Application No. CN201811443482.2, filed on Nov. 29, 2018, the entire content of which is incorporated herein by reference.

TECHNICAL FIELD

The present disclosure relates to a method for inject an electronic cigarette liquid ("E-liquid") into a cartridge of an electronic cigarette, a cartridge of an electronic cigarette configured to receive the E-liquid injected based on this method, and an electronic cigarette assembly including the electronic cartridge.

BACKGROUND

FIGS. 1 and 2 show a currently available electronic cigarette based on conventional technologies. The electronic cigarette may also be referred to as an atomization generating device or an atomizer. The electronic cigarette includes a cartridge 1. The cartridge 1 includes an E-liquid storage tank 12 and a base 11. An air inlet 111 is provided in the base 11. An upper portion of the cartridge 1 is provided with an air outlet 13. The air inlet 111 and the air outlet 13 are connected through a vapor channel 14. A side wall of the vapor channel 14 is provided with a liquid inlet. The liquid inlet is connected with the E-liquid storage tank 12. An atomizing core is provided in the vapor channel 14. The atomizing core includes an E-liquid guiding body 15 and a heating wire 16. The E-liquid guiding body 15 absorbs the E-liquid from the E-liquid storage tank 12 through the liquid inlet. The E-liquid in the E-liquid storage tank 12 continuously flows into the E-liquid guiding body 15 through the liquid inlet. After the heating wire 16 heats the E-liquid already absorbed by the E-liquid transferring body 15 to atomize the E-liquid, the E-liquid guiding body 15 continues to absorb the E-liquid from the E-liquid storage tank 12.

In the above electronic cigarette according to the conventional technologies, although the E-liquid guiding body 15 has a capability of absorbing the E-liquid and transferring the E-liquid, the capability of absorbing the E-liquid is limited.

The heating element (e.g., heating wire) continuously atomizing the E-liquid absorbed by the E-liquid guiding body 15 can be roughly understood as follows: the E-liquid in the E-liquid storage tank 12 sequentially passes through the liquid inlet and the E-liquid guiding body 15 to arrive at the heating wire 16. The heating wire 16 atomizes the E-liquid. The atomized E-liquid becomes a gas. The gas flows to the air outlet 13 through the vapor channel 14. The air inlet 111 provides continuous fresh air to the gaseous E-liquid, to ensure that the atomized E-liquid flows out through the vapor channel 14 and the air outlet 13. Because the air inlet 111 and the air outlet 13 are both connected with the E-liquid storage tank 12 through the vapor channel 14, the E-liquid guiding body 15, and the liquid inlet, when a pressure of the E-liquid in the E-liquid storage tank 12 is different from an air pressure of an external environment that is external to the E-liquid storage tank 12, for example, when the air pressure in the E-liquid storage tank 12 is greater than the air pressure of the external environment, more specifically, when a pressure generated by the gas in the E-liquid storage tank 12 is F1, a sum of a pressure generated by the external atmosphere and a pressure generated by the E-liquid guiding body 15 absorbing the E-liquid is F2, and when F1>F2, the E-liquid in the E-liquid storage tank 12 flows out through a liquid passage including the liquid inlet, the E-liquid guiding body 15, the vapor channel 14, the air outlet 13, and the air inlet 111, thereby causing the E-liquid to flow out of the cartridge 1, i.e., the leakage of the E-liquid. In addition, if the cartridge 1 is manufactured in a region A, and the pressure of the E-liquid in the cartridge 1 is equal to the atmospheric pressure of the external environment when manufactured in the region A, and if the cartridge 1 is transported to a region B thereafter, and the atmospheric pressure of the region B is lower than the atmospheric pressure of region A, leak of the E-liquid stored in the cartridge 1 will likely occur.

SUMMARY

The primary objective of the present disclosure is to overcome the disadvantages of the conventional technologies. First, a method for injecting an E-liquid into a cartridge of an electronic cigarette is provided, which has a feature that can avoid the leakage of the E-liquid that could be caused by a change in the air pressure of the external environment. The cartridge of the electronic cigarette that is injected with the E-liquid based on the disclosed method has a dual-seal structure and a reverse pressure differential feature. The disclosed method may also be referred to as a dual-seal reverse pressure differential electronic cigarette cartridge E-liquid injection method.

To better achieve the primary objective, prior to describing the technical solutions of the present disclosure, the internal and external factors that can contribute to the leakage of the E-liquid of an electronic cigarette are analyzed first.

1. Internal Air Pressure Factor, Primarily Referring to a Pattern of Changes of Internal Air Pressure of the Electronic Cigarette The compositions of the E-liquid are complicated, which can roughly include the following categories: a basic material category (e.g., propylene glycol and glycerol), a liquid flavoring agent category (which may be a synthetic or natural essence that can be miscible with the basic material), and a biological extract category (which is generally a small amount of solid plant-based extract). A mixture of these compositions forms a liquid, i.e., a fluid, at a room temperature. As a fluid, the mixture has characteristics of a fluid. The leakage of the E-liquid means that a flow motion of the E-liquid is generated in a non-operating state of the cartridge and the E-liquid flows out of the E-liquid storage tank of the cartridge. The leakage indicates that the original non-leakage static equilibrium of the E-liquid in the cartridge has been broken. A new temporary equilibrium is generated by the flow motion of the E-liquid. The reason causing the change of the equilibrium can be attributed to multiple factors, such as a change in the pressure of the external environment, a change in the external gravitational field, a change in the temperature, etc. Many factors can cause a change in the original equilibrium. Whichever factor it may be, the result is that the internal pressure and the external pressure of the connecting portion between the liquid passage and the air passage of the cartridge have changed. As a person having ordinary skills in the art can appreciate, a fluid tends to flow from a high pressure region to a low pressure region.

Referring to FIGS. 1 and 2 that show the structure of the electronic cigarette according to conventional technologies, the connecting portion between the E-liquid and the air passage is formed by an E-liquid guiding cotton, a non-woven fabric, and a resistive wire. The operation performed by the atomizer is to atomize the E-liquid transferred by the liquid guiding cotton by heating the E-liquid through the heating wire. Then a negative pressure is generated in the atomized region.

The negative pressure refers to a gas pressure state that is lower than a normal pressure, which is often referred to as the "vacuum." The negative pressure is often used to indicate a relative pressure in an industrial environment. For example, if the atmospheric pressure is used as the zero position, i.e., P0, a pressure that is lower than the atmospheric pressure may be represented by a negative value, hence named a "negative pressure." The larger the absolute value of the negative value, the greater the vacuum level. The normal pressure is one atmospheric pressure, also referred to as a standard pressure, i.e., 1 atm, which is typically represented as 100 KPa or 101 KPa.

The E-liquid in the E-liquid storage tank of the cartridge can be continuously transferred to locations adjacent the heating wire through the E-liquid guiding cotton. As the E-liquid is consumed in the atomization, a negative pressure may be generated inside the E-liquid storage tank, which may hinder the supply of the E-liquid to the E-liquid guiding cotton. When the negative pressure inside the E-liquid storage tank exceeds a resistance of the E-liquid guiding cotton, the atmospheric pressure of the external environment may be released in the E-liquid storage tank through the E-liquid guiding cotton, thereby arriving at a static air pressure equilibrium in the E-liquid storage tank. This constitutes one operating period. Therefore, two equilibriums may be needed when designing the atomizer, one is a dynamic equilibrium when the cartridge is operating, another is a static equilibrium when the cartridge is non-operating. The design requirement for the former dynamic equilibrium when the cartridge is operating is that the speed of E-liquid supply is equal to the speed of atomization in theory. An excessive E-liquid supply can cause an E-liquid ejection. An insufficient E-liquid supply can cause dry burning of the heating wire, which may damage the atomizing core. This equilibrium may be controlled through the tightness of the E-liquid guiding cotton, and the pressure differential of the negative pressure generated by the air passage. During operation, a negative pressure environment may be created at the inner wall of the air passage. Assuming that the internal pressure of the E-liquid storage tank is p1, the pressure in the air passage external to the E-liquid storage tank is p2, if p1 is greater than the pressure p2 of the external air passage, the E-liquid can be transferred out of the E-liquid storage tank smoothly. The latter static equilibrium when the cartridge is non-operating means that when the cartridge is in a static non-operating state, it is in a non-leakage state (typically the pressure differential is within a predetermined range of pressure differential changes). This equilibrium can also be achieved through the characteristics and the tightness of the E-liquid guiding cotton. However, the E-liquid guiding cotton is not a valve. So the E-liquid guiding cotton is associated with a passing coefficient, i.e., the pressure differential. The pressure differential under which the E-liquid can pass through the E-liquid guiding cotton may be represented by $\Delta p1$ (which may also be referred to as an anti-E-liquid-leakage coefficient), and the pressure differential under which the air can pass through the E-liquid guiding cotton soaked with the E-liquid may be represented by $\Delta p2$ (which may also be referred to as an anti-air-resistance coefficient), where $\Delta p2$ is greater than $\Delta p1$. Because when the air passes through the E-liquid guiding cotton soaked with the E-liquid, the air needs to overcome the gravity and the resistance of the friction of the air passage, the following relationship may exist:

1), when $p1-p2>\Delta p1$, E-liquid flows from the E-liquid storage tank to the exterior of the E-liquid storage tank (i.e., normal dynamic supply of the E-liquid when the cartridge is in an operating state, and abnormal static leakage of the E-liquid when the cartridge is in a non-operating state)

2), when $p2-p1>\Delta p2$, air flows into the E-liquid storage tank from the exterior of the E-liquid storage tank (air return state)

3), when $p2-p1\leq\Delta p1$, the E-liquid is blocked from flowing out of the E-liquid storage tank (static non-leak)

4), $(p2-p1)-(\Delta p2-\Delta p1)\geq\Delta p1$ (design requirement: air permeable and no leak of E-liquid)

In the above, the anti-E-liquid-leakage coefficient $\Delta p1$ of the E-liquid guiding cotton and the anti-air-resistance coefficient $\Delta p2$ of the E-liquid guiding cotton are both results obtained with respect to characteristics of a same E-liquid and a same E-liquid guiding cotton. The corresponding parameters may be obtained through specific experiments. These coefficients may be proportional to the density of the E-liquid guiding cotton, proportional to a lipophilic coefficient of the E-liquid guiding cotton, and inversely proportional to a viscosity of the E-liquid under the precondition that the E-liquid is replaced.

After understanding the basic operation principle of the atomizer, one can appreciate that due to characteristics of the internal structure, during operation, the liquid passage and the air passage need to be connected. If the design or the assembly is not reasonable, E-liquid leakage phenomenon is likely to occur. Here, two equilibrium systems (dynamic and static) both need to be simultaneously established, in order to effectively control the controllability of the leakage of the E-liquid of the atomizer. In actual operations of the atomizer, the processes are much more complex than those described herein. For example, the internal pressure p1 in the E-liquid storage tank described in the equation may undergo a changing process due to the gravity, which includes a slightly decreasing process as the E-liquid is consumed. During operations, the temperature of the atomizer may increase as the time elapses, and the air pressure in the atomizer may gradually increase. The speed of the increase in the air pressure may be related to the magnitude of the power and the design of the air passage of the atomizer. The viscosity of the E-liquid may decrease as the temperature increases, thereby affecting the liquid passing coefficient and other factors. The pressure p2 of the air passage external to the E-liquid storage tank may not be invariant. It may decrease during a dynamic operating state, and may restore to a normal room pressure during a static non-operating state. On the other hand, the atmospheric pressure in a room also may not be invariant. The change in the atmospheric pressure may not be controllable. Therefore, the atmospheric pressure in the room may be a critical factor that can affect the leakage of the E-liquid from the cartridge. Therefore, next, the change pattern and change range of the external factor, i.e., the atmospheric pressure in a room, are described to discuss how to avoid the leakage of the E-liquid from the cartridge.

2, External Pressure Factor, Primarily Referring to the Change Pattern of the Atmospheric Pressure of the External Environment of the Electronic Cigarette.

1) the daily atmospheric pressure in every region is changing. The low pressures and the high pressures each have two peak values every day. Low pressure peak values that are suitable for the E-liquid injection of the electronic cigarette appear at 3-4 p.m. in the afternoon and 3-4 a.m. in the morning.

2) in addition to being related to the daily amplitude, the pressure change is also related to the latitude. The pressure change tends to be larger in low latitude regions, and the pressure change tends to be smaller in high latitude regions. The daily amplitude of pressure changes for regions with latitudes higher than 50 degrees is typically smaller than 1 hPa. Using Shenzhen, where the largest electronic cigarette manufacturing base is located, as an example, Shenzhen belongs to a low latitude region. The normal amplitude of pressure changes is between about 2.5 to about 4.0 hPa. The yearly average pressure of Shenzhen is about 1009.6 hPa. Each season has different pressure characteristics. Pressures in summer are relatively lower, and pressure changes are relatively greater; pressures in winter are relatively higher, and pressure changes are relatively smaller. Middle-latitude regions of China have pressure changes between about 3-4 hPa. The region with the greatest pressure change is the Tibet plateau, where the daily pressure change amplitude can reach about 6.5 hPa.

3) the effect of extreme weather on the atmospheric pressure. The atmospheric pressure is low for ultra-high temperatures and hot and humid weather. Weathers such as typhoon, rain, and snow can also cause drastic changes in the atmospheric pressure. In general, the range of changes in the atmospheric pressure is within about 50 hPa. A historical lowest atmospheric pressure record is about 870 hPa, which is about 143 hPa lower than a typical daily atmospheric pressure (standard atmospheric pressure is about 1013 hPa).

4) the effect of air transportation on air pressure, i.e., the air pressure changes in the cargo cabin of an aircraft cabin. When an aircraft transports cargos or passengers, the air pressure in the cabin may not be constant, but instead, may undergo an air pressure changing process. When the aircraft is on the ground, the cabin is an open system, and the air pressure in the cabin is consistent with the air pressure of the atmosphere on the ground. When the aircraft takes off and ascends, due to the structure of the aircraft, the difference between the air pressure inside the cabin and the external air pressure cannot be too large. Therefore, the ascending process of the aircraft is an air pressure decreasing process. When cruising, the air pressure inside the aircraft is substantially constant. When descending, the air pressure inside the aircraft increases as the height decreases, so the air pressure inside the cabin undergoes an air pressure increasing process. The range of air pressure changes is typically about 20% of the standard pressure, which is about 200 hPa.

5) the effect of the sea level altitude on the air pressure. The effect of the sea level altitude on the air pressure is significant. One can refer to a sea level altitude and air pressure table. In general, within a sea level altitude of 3000 meters, for every increase of 100 meters in the altitude, the air pressure drops by about 10 hPa.

Based on the above-described characteristics of the changes in the external atmospheric pressure P0, one can understand that it is actually the range of changes of the internal pressure p2 within the air passage that is connected with the external atmosphere in a typical condition. Therefore, in order to avoid leakage of the E-liquid in the atomizer during transportation or use under the above-described conditions, the design of the liquid passage of the atomizer need to satisfy $(p2-p1)-(\Delta p2-\Delta p1)\geq\Delta p1$, which is described above in the internal pressure factor paragraphs. In other words, the design needs to satisfy the requirement of being air permeable and no leakage of the E-liquid, to ensure that the E-liquid guiding body can absorb, to a maximum degree, the E-liquid stored in the E-liquid storage tank, and to avoid leakage of the E-liquid in a non-operating state, while satisfying the condition of a smooth supply of the E-liquid in an operating state. The assembly of the cartridge and the packaging also need to achieve no-leakage of the E-liquid under these conditions. Corresponding measures may be taken with respect to cartridges to be used in regions of different sea levels. Pressure changes in a typical condition, such as the daily atmospheric pressure change amplitude, may satisfy such conditions relatively easily, and therefore, may not require special processing. Pressure changes under special circumstances, such as the pressure differential during the air transportation process, may need special processing. Therefore, the specific objective of the present disclosure can be set as no-leakage of E-liquid under the condition of 200 hPa lower than the normal atmospheric pressure, i.e., under the condition of a negative pressure of −200 hPa.

Therefore, one of the specific objectives of the present disclosure is to overcome the defects in the conventional technologies. First, the present disclosure provides a dual-seal reverse pressure differential cartridge E-liquid injection method, which has a feature of no-leakage of E-fluid under a negative pressure that is 200 hPa below the normal atmospheric pressure. Sometimes the internal air pressure in the electronic cigarette may be maintained between about 700-950 hPa in the above-described production and storage environment, which means the corresponding negative pressure value is about −200 hPa.

The formation of the negative pressure environment can be realized in a closed environment. That is, at least the internal pressure of the E-liquid storage tank of the electronic cigarette can be rendered lower than the pressure of the external closed environment external to the E-liquid storage tank. That is, a relative negative pressure can be formed in the E-liquid storage tank of the cartridge relative to the external closed environment external to the E-liquid storage tank. Alternatively, the formation of the negative environment may be realized in an open environment, i.e., a relative negative pressure can be formed in the E-liquid storage tank of the cartridge relative to the open environment external to the E-liquid storage tank. The above relative negative pressure may be the reverse pressure differential. Regardless of which environment is used to achieve the relative negative pressure in the E-liquid storage tank of the cartridge, the relative negative pressure environment may be isolated from the external open atmospheric environment. The isolation may be realized through a sealed external package, such as a sealed bag. The above-described dual seals can be understood as an original (first) sealing through the internal structure of the cartridge after the E-liquid is injected, and a sealed external package, e.g., a second sealing through a sealing bag.

The present disclosure may be realized in the following manner: a dual-seal reverse pressure differential electronic cigarette cartridge E-liquid injection method may include the following steps:

a. selecting an E-liquid guiding body, and assembling the E-liquid guiding body with the cartridge. The cartridge may include an E-liquid storage tank configured for receiving an injection of the E-liquid. The E-liquid guiding body is configured to be in a fluidic communication with the E-liquid that is injected into the E-liquid storage tank, b. injecting the E-liquid into the E-liquid storage tank of the cartridge;

c. sealing the cartridge after the injection of the E-liquid in a sealed bag. The internal pressure in the E-liquid storage tank of the cartridge after the E-liquid injection is P1, the pressure of the external environment of the E-liquid storage tank of the cartridge after the E-liquid injection is P2, and P2>P1. That is, a negative pressure, i.e., a reverse pressure differential, may be formed in the E-liquid storage tank of the cartridge relative to the air pressure of the external environment external to the E-liquid storage tank of the cartridge. The anti-E-liquid-leakage coefficient ΔP1 and the anti-air-resistance coefficient ΔP2 of the E-liquid guiding body may satisfy (P2−P1)−(ΔP2−ΔP1)≥ΔP1, to ensure that the E-liquid guiding body can absorb, to the maximum degree, the E-liquid stored in the E-liquid storage tank after the cartridge is injected with the E-liquid, while avoiding leakage of the E-liquid in the non-operating state of the cartridge, and while providing a smooth supply of the E-liquid in the operating state of the cartridge.

If there exists a space between the sealed cartridge and the sealing bag, then the air pressure of the external environment external to the E-liquid storage tank of the cartridge may be realized in the sealed space of the sealing bag. The pressure in the sealed space of the sealing bag, i.e., the air pressure of the external environment external to the E-liquid storage tank of the cartridge that is sealed in the sealing bag may be P2, and P2>P1. In this situation, the sealing bag may have a limited elasticity, such that it does not undergo a deformation or crack that is greater than a predetermined deformation or crack level when the external atmospheric pressure changes. Specifically, for example, when the external atmospheric pressure decreases, e.g., by 10-20%, i.e., the external atmospheric pressure decreases to be lower than one atmospheric pressure, the pressure P2 inside the sealing bag is greater than the already decreased external atmospheric pressure, and the sealing bag does not expand or deform to a level that is greater than the predetermined deformation or crack level. The purpose of having the sealing bag not expanding or deforming to a level that is greater than the predetermined deformation or crack level is to ensure that the pressure P2 inside the sealing bag does not undergo a change that is greater than a predetermined pressure change level, thereby effectively avoiding the occurrence of E-liquid escaping from the E-liquid storage tank to the sealing bag. Therefore, the material of the sealing bag has a limited elasticity to ensure that the sealing bag does not undergo a deformation greater than the predetermined deformation level within the range of air pressure changes. In another situation, when the external atmospheric pressure changes, even if the sealing bag undergoes a slight expansion, such an expansion does not affect the normal use. Such expansion results in a slight expansion on the appearance, which is not discernable by naked eyes.

If the sealed cartridge and the sealing bag are tightly coupled, the space between the cartridge and the sealing bag may be negligible. Then the air pressure P2 of the external environment external to the E-liquid storage tank of the cartridge may be regarded as the atmospheric pressure P0 of the external atmosphere. In this situation, the internal air pressure P1 of the E-liquid storage tank of the cartridge is lower than the air pressure P2 of the external environment external to the E-liquid storage tank of the cartridge, i.e., the atmospheric pressure P0 of the external atmosphere, that is, P2=P0>P1.

Further, the cartridge may include a base. An air inlet may be provided in the base. An air outlet may be provided at an upper portion of the cartridge. The air inlet and the air outlet may be connected with a vapor channel. A side wall of the vapor channel may be provided with a liquid inlet. The liquid inlet may be connected with the E-liquid storage tank. The vapor channel may be provided with an atomizing core. The atomizing core may include an E-liquid guiding body and a heating element (e.g., a heating wire). The E-liquid guiding body may absorb the E-liquid through the liquid inlet. The heating element may atomize the E-liquid absorbed by the E-liquid guiding body.

Further, after the E-liquid injection is completed, a lower plug and an upper plug may be provided to the cartridge. The lower plug may be assembled to the air inlet and the upper plug may be assembled to the air outlet. Then the cartridge may be sealed in the sealing bag.

In some embodiments, in step b, the E-liquid is injected into the E-liquid storage tank of the cartridge in a negative pressure environment. The pressure of the E-liquid in the E-liquid storage tank of the cartridge is P1, and P1 is a normal pressure, which is an atmospheric pressure P0 of the external atmosphere.

In some embodiments, after the E-liquid is injected into the E-liquid storage tank of the cartridge, the E-liquid storage tank of the cartridge is vacuumed. The E-liquid in the E-liquid storage tank after the vacuum is formed has a pressure P1. The pressure P1 is a negative pressure.

In some embodiments, in step b, the E-liquid is injected into the E-liquid storage tank of the cartridge in a negative pressure environment. The E-liquid in the E-liquid storage tank of the cartridge has a pressure P1. Pressure P1 is a negative pressure.

In some embodiments, in step b, the E-liquid that has been heated under a normal pressure is injected into the E-liquid storage tank of the cartridge. After the E-liquid cools down, the pressure of the E-liquid is P1, and P1 is a negative pressure.

Further, when there is a sealed space between the sealing bag and the cartridge:

In step c, sealing the cartridge that has been injected with E-liquid in a normal (atmospheric) pressure environment in a sealing bag having a pressure higher than the normal pressure. After the sealing bag is sealed, the pressure inside the sealing bag is P2, P2>P0, which is the atmospheric pressure of the external atmosphere.

The sealing bag having a pressure higher than the normal pressure may be formed by injecting a gas having a pressure higher than the normal pressure into the sealing bag. The pressure formed after the sealing bag is sealed is P2, P2>P1=P0. The gas may be air or an inert gas.

In some embodiments, in step c, the cartridge that has been injected with E-liquid in a negative pressure environment is sealed in a sealing bag having a normal pressure environment. After the sealing bag is sealed, the pressure in the sealed sealing bag is P2, P2=P0>P1.

In some embodiments, in step c, sealing, in the sealing bag having a normal pressure, the cartridge that has been injected with hot E-liquid in a normal pressure environment after the hot E-liquid has been cooled down. The pressure inside the sealing bag after the sealing bag is sealed is P2, P2=P0>P1.

Further, when the sealing bag and the cartridge are tightly coupled, in step c, the cartridge that has been injected with E-liquid in a negative pressure environment is tightly sealed in the sealing bag. The tight sealing may be achieved by selecting a sealing bag having a suitable size, placing the cartridge in the sealing bag, and vacuuming the sealing bag such that the sealing bag and the cartridge are tightly coupled.

The sealing bag used in the above two situations can achieve the second sealing for the cartridge that has been injected with the E-liquid to effectively isolate the internal air pressure of the E-liquid storage tank of the cartridge from pressure exchange with the atmospheric pressure of the external atmosphere.

In the present disclosure, by forming a relative negative pressure environment between the interior and the exterior of the E-liquid storage tank of the cartridge that has been injected with the E-liquid, and by forming a second sealing through the sealing bag, the E-liquid in the E-liquid storage tank of the cartridge can be effectively isolated from the external atmospheric environment, thereby reducing or even eliminating the effect of the change in the external atmospheric pressure on the pressure inside the E-liquid storage tank in the cartridge after the cartridge is injected with the E-liquid. As a result, the leakage of the E-liquid due to the change in the external air pressure can be effectively avoided. In the meantime, the following issue can be avoided: the cartridge is manufactured in one region and used in a different region having a lower atmospheric pressure, which can cause the leakage of the E-liquid. Therefore, contamination of the external environment by the leaked E-liquid can be effectively avoided and the quality of the E-liquid can be enhanced.

BRIEF DESCRIPTION OF THE DRAWINGS

To better explain the technical solutions of the present disclosure and of the conventional technologies, the accompany drawings that are referred to when describing the present disclosure or the conventional technologies will be briefly introduced. Obviously, the accompanying drawings described below are only some embodiments of the present disclosure. A person having ordinary skills in the art can derive other drawings based on these drawings without creative labor.

DETAILED DESCRIPTION OF THE EMBODIMENTS

The technical solution of the embodiments of the present disclosure will be described in detail with reference to the accompanying drawings. The described embodiments are merely some embodiments of the present disclosure, and are not all embodiments of the present disclosure. Based on the embodiments of the present disclosure, a person having ordinary skills in the art can obtain other embodiments without creative labor. Such embodiments all fall within the scope of protection of the present disclosure.

Figure 1:
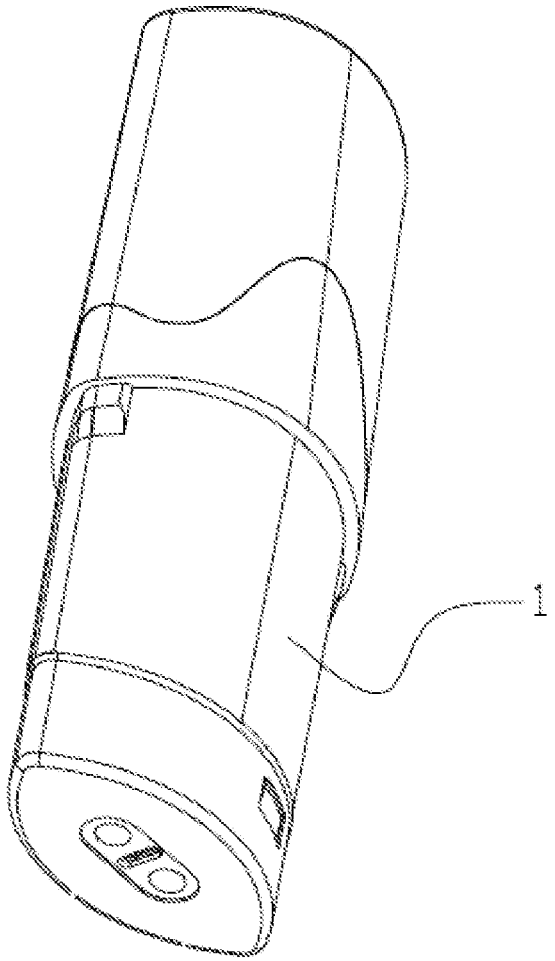
FIG. 1 is a perspective view of an electronic cigarette according to conventional technology.
Figure 2:
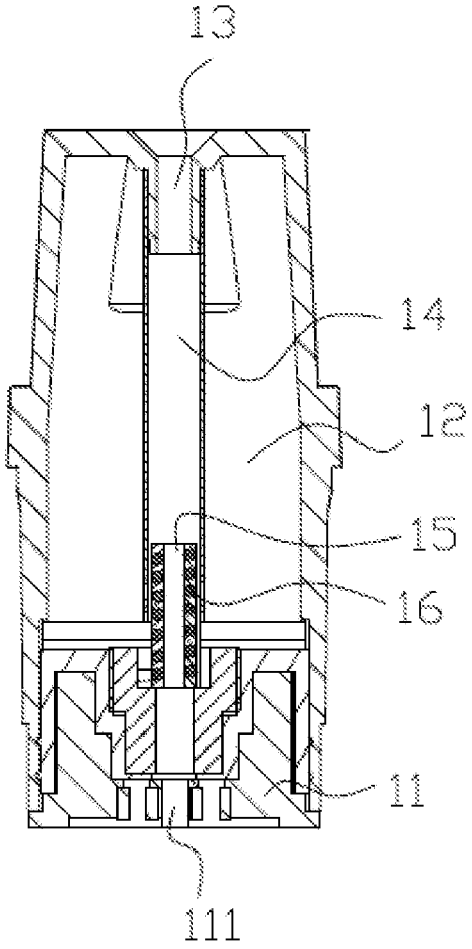
FIG. 2 is a cross-sectional view of the electronic cigarette according to the conventional technology.
Figure 3:
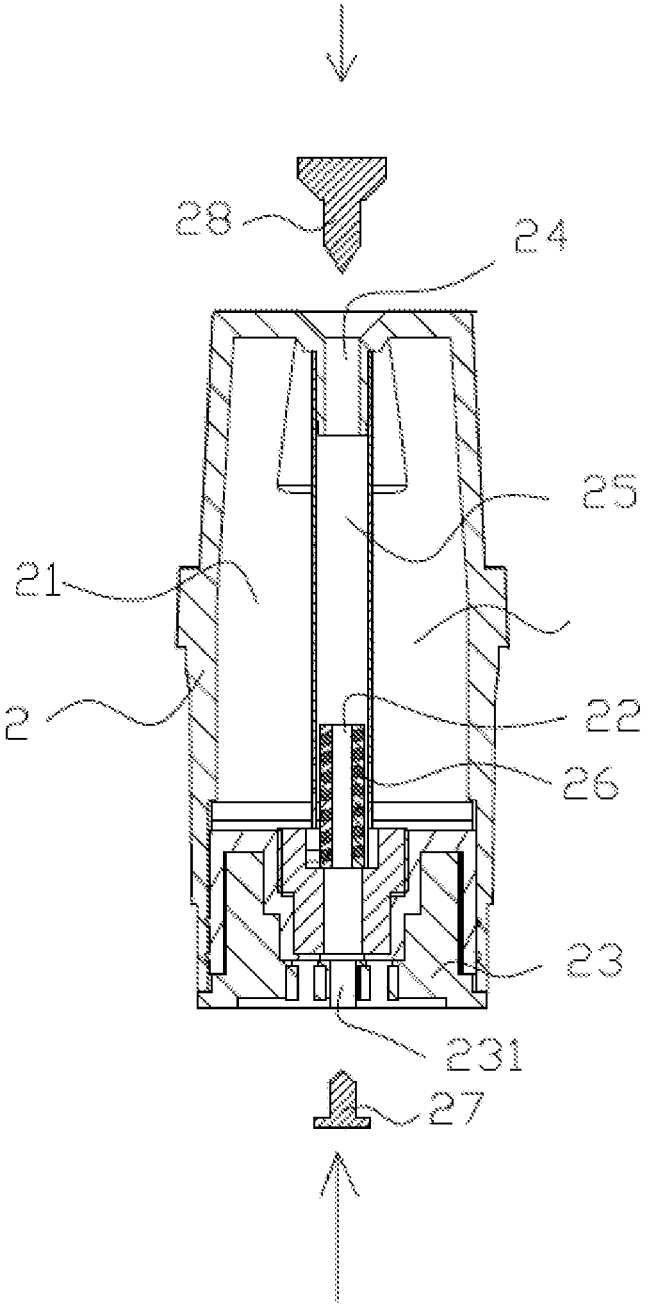
FIG. 3 is a cross-sectional view of a cartridge according to an embodiment of the present disclosure.
Figure 4:
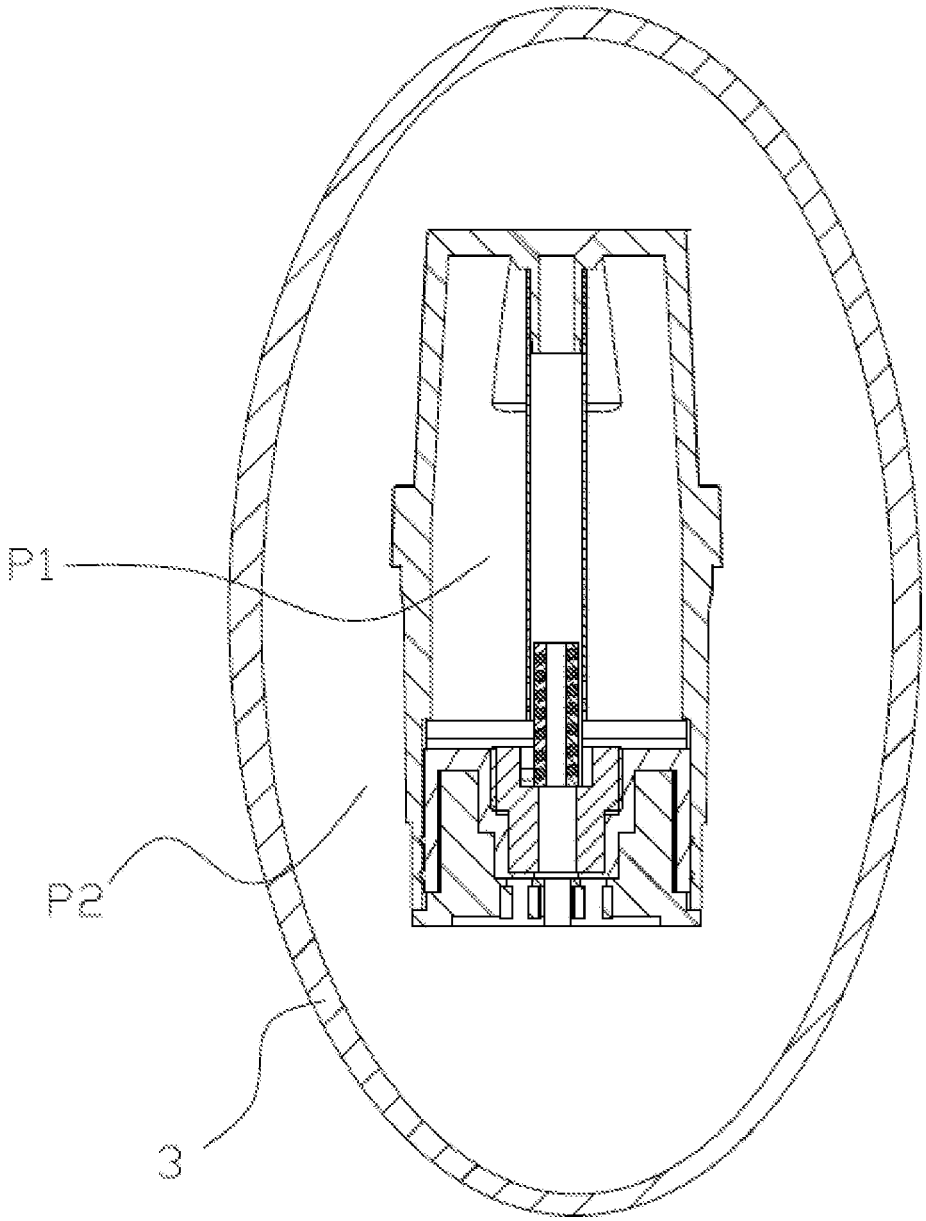
FIG. 4 is a schematic illustration of the cartridge and the sealing bag after they are coupled, according to an embodiment of the present disclosure.
Figure 5:
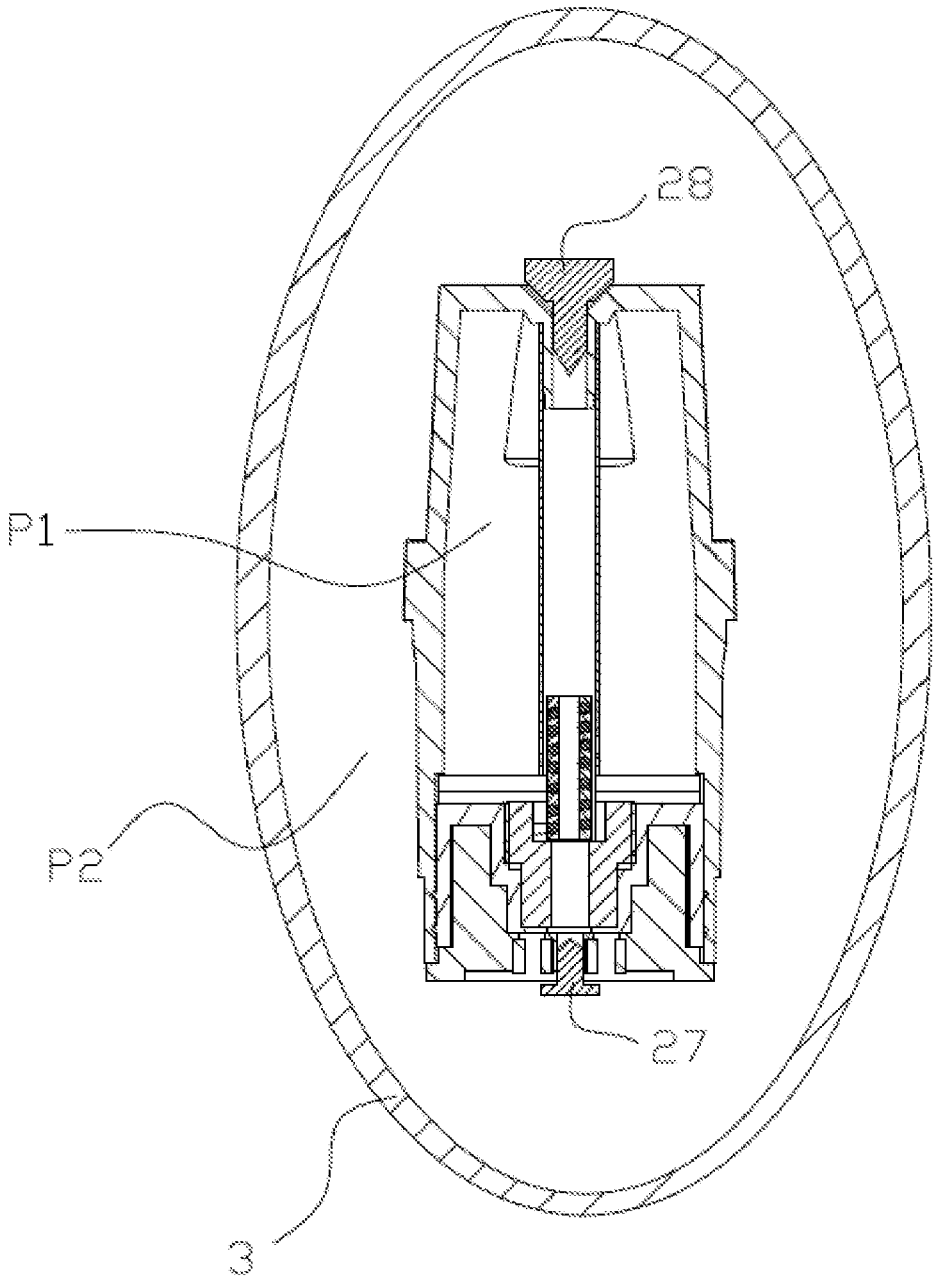
FIG. 5 is a schematic illustration of the cartridge and the sealing bag after they are coupled, according to another embodiment of the present disclosure.
Figure 6:
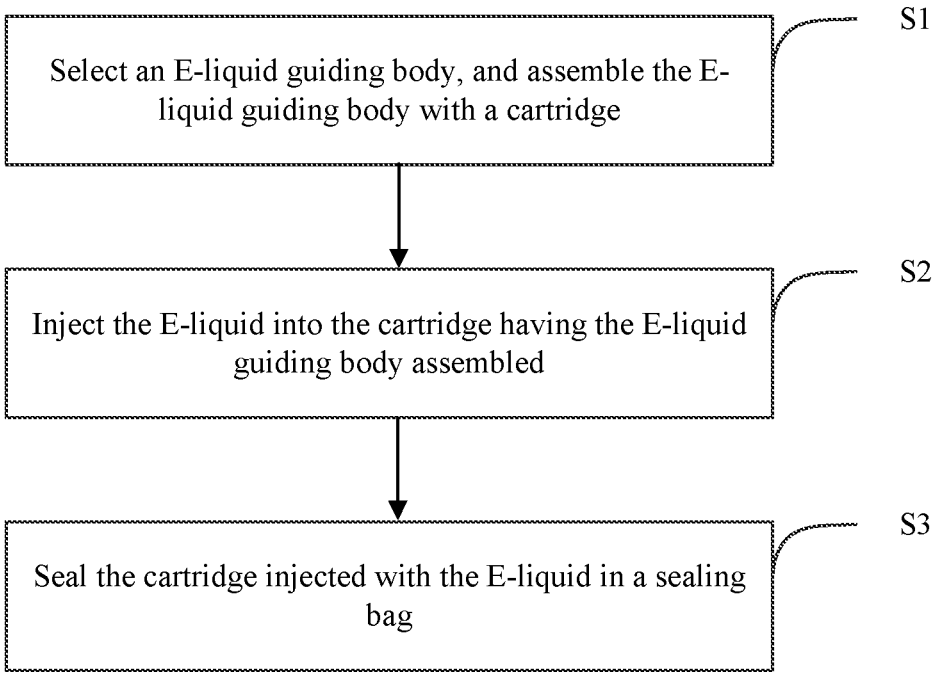
FIG. 6 is a flow chart illustrating a manufacturing process according to an embodiment of the present disclosure.

As shown in FIG. 3-FIG. 6, the embodiments of the present disclosure provide a dual-seal reverse pressure differential cartridge E-liquid injection method, including the following steps: a. selecting an E-liquid guiding body 22 and an empty cartridge 2, and assembling the E-liquid guiding body 22 with the empty cartridge 2. The cartridge 2 may include an E-liquid storage tank 21. The E-liquid guiding body 22 is configured to be in fluidic communication with the E-liquid injected into the E-liquid storage tank 21. The anti-E-liquid-leakage coefficient $\Delta P1$ of the E-liquid guiding body 22 and the anti-air-resistance coefficient $\Delta P2$ may satisfy $(P2-P1)-(\Delta P2-\Delta P1)\geq\Delta P1$. P1 is the internal pressure in the E-liquid storage tank of the cartridge after the E-liquid is injected. P2 is the external pressure external to the E-liquid storage tank after the E-liquid is injected. That is, after the cartridge is injected with the E-liquid, the E-liquid guiding body 22 can absorb, to the maximum degree, the E-liquid from the E-liquid storage tank 21, while avoiding leakage of the E-liquid and maintaining a smooth supply of the E-liquid in the operating state. b. injecting the E-liquid into the E-liquid storage tank 21. The E-liquid has a pressure P1. c. after the injection of the E-liquid is completed, sealing the cartridge 2 in a sealing bag 3. The E-liquid guiding body 22 may be an E-liquid guiding cotton, which is a medium for guiding the E-liquid.

The cartridge 2 may include a base 23. An air inlet 231 may be provided in the base 23. An upper portion of the cartridge 2 may be provided with an air outlet 24. The air inlet 231 and the air outlet 24 may be connected through a vapor channel 25. A side wall of the vapor channel 25 may be provided with a liquid inlet. The liquid inlet may be connected with the E-liquid storage tank 21. An atomizing core may be provided in the vapor channel 25. The atomizing core may include the E-liquid guiding body 22 and a heating element 26. The E-liquid guiding body 22 may absorb the E-liquid through the liquid inlet. The heating element 26 may atomize the E-liquid absorbed in the E-liquid guiding body 22.

After the injection of the E-liquid is completed, a lower plug 27 and an upper plug 28 may be provided to the cartridge. The lower plug 27 may be assembled to (e.g., inserted into) the air inlet 231, and the air inlet 231 may be sealed by the lower plug 27. The upper plug 28 may be assembled to (e.g., inserted into) the air outlet 24. The cartridge 2 can then be sealed in the sealing bag 3. The air outlet 24 may be sealed by the upper plug 28, which may further avoid the leakage of the E-liquid. The lower plug 27 and the upper plug 28 may both have a thread tightening configuration. Alternatively, the lower plug 27 and the upper plug 28 may seal the sealing bag through a tightly matching snap-fit configuration. The sealing of the cartridge through the plugs may be regarded as an embodiment of a first sealing. By the second sealing through the sealing bag, a dual seal may be realized in the present disclosure.

If there exists a sealing space between the sealed cartridge and the sealing bag, then the pressure P2 of the external environment external to the E-liquid storage tank of the cartridge may be realized in the sealed space inside the sealing bag. The pressure of the sealed space inside the sealing bag, i.e., the pressure P2 of the external environment external to the E-liquid storage tank of the cartridge in the sealing bag, satisfies $P2>P1$. In other words, a negative pressure is generated in the interior of the E-liquid storage tank of the cartridge relative to the exterior of the E-liquid storage tank of the cartridge, i.e., the sealed space inside the sealing bag.

When there exists a certain space between the dual-sealed cartridge and the sealing bag, the sealing bag has a limited elastic shrink capability, such that the sealing bag does not undergo a deformation or crack greater than a predetermined deformation or crack level when the atmospheric pressure of the external atmosphere changes. Specifically, for example, when the atmospheric pressure of the external atmosphere reduces, for example, by 10-20%, i.e., when the atmospheric pressure of the external atmosphere reduces to below one atmospheric pressure, the pressure P2 inside the sealing bag is greater than the already reduced atmospheric pressure, the sealing bag does not undergo an expansion or deformation that is greater than the predetermined deformation level. The purpose of not having an expansion or deformation that is greater than the predetermined deformation level is to ensure that the pressure P2 inside the sealing bag does not have changes greater than a predetermined pressure change level, thereby effectively avoiding the escape of the E-liquid stored in the E-liquid storage tank to the sealing bag. Therefore, the elasticity of the material of the sealing bag is limited, to ensure that the sealing bag does not undergo a deformation greater than the predetermined deformation level within a range of pressure changed. In another situation, when the atmospheric pressure of the external atmosphere changes, even if the sealing bag undergoes a slight expansion, such expansion does not affect the normal use. Such expansion is a slight expansion in the appearance, which is not discernable by naked eyes.

The relative negative pressure environment formed between the interior and exterior of the E-liquid storage tank of the cartridge may be realized based on the following methods according to different pressures under which the E-liquid is injected:

In a first situation, in step b, the E-liquid having a normal (atmospheric) pressure is injected into the E-liquid storage tank 21. The pressure of the E-liquid is P1. The pressure P1 of the E-liquid injected under the normal pressure in the E-liquid storage tank 21 is the normal pressure, i.e., the external atmospheric pressure P0.

In step c, the cartridge that has been injected with E-liquid under the normal pressure environment is sealed in a sealing bag having a pressure higher than the normal pressure. The pressure in the sealing bag after the sealing bag is sealed is P2. P2>P1=P0, which is the normal pressure or the external atmospheric pressure.

The sealing bag having a pressure higher than the normal pressure may be realized by injecting a gas having a pressure higher than the normal pressure into the sealing bag. The gas may be air or an inert gas.

In a second situation, in step b, the pressure P1 of the E-liquid inside the E-liquid storage tank of the cartridge is made lower than the external air pressure P2 external to the E-liquid storage tank of the cartridge, i.e. P2>P1, such that a relative negative pressure environment is formed in the sealed space of the sealing bag, i.e., between the interior of the E-liquid storage tank of the cartridge after the E-liquid is injected and the external environment external to the E-liquid storage tank of the cartridge.

The negative pressure environment may be formed through the following methods:

after the E-liquid is injected into the E-liquid storage tank of the cartridge under the normal pressure environment, the E-liquid storage tank of the cartridge may be sucked to form a vacuum. The pressure of the E-liquid inside the E-liquid storage tank after the vacuum is formed is P1, which is lower than the external air pressure P2 of the external environment external to the E-liquid storage tank of the cartridge, i.e., P1 is a negative pressure.

the E-liquid is injected into the E-liquid storage tank in a negative pressure environment. The pressure of the liquid inside the E-liquid storage tank of the cartridge is P1, which is lower than the external air pressure P2 of the external environment external to the E-liquid storage tank of the cartridge, i.e., P1 is a negative pressure.

the E-liquid that has been heated in a normal pressure is injected into the E-liquid storage tank 21. After the E-liquid cools down, the E-liquid has a pressure P1. The pressure P1 of the E-liquid stored in the E-liquid storage tank of the cartridge is lower than the air pressure P2 of the external environment external to the E-liquid storage tank of the cartridge, i.e., P1 is a negative pressure.

In step c, a relative negative pressure environment may be formed in the E-liquid storage tank of the cartridge based on the pressure generated in step b inside the sealing bag that packages the cartridge:

sealing the cartridge that has been injected with the E-liquid in a normal pressure environment in a sealing bag having a pressure higher than the normal pressure. The pressure generated in the sealing bag after the sealing bag is sealed is P2.

The pressure higher than the normal pressure in the sealing bag may be generated by injecting a gas having a pressure higher than the normal pressure into the sealing bag. The pressure in the sealing bag after the sealing bag is sealed is P2, P2>P1=P0. The gas may be air or an inert gas.

sealing the cartridge that has been injected with the E-liquid in a negative pressure environment in a sealing bag in a normal pressure environment. The pressure inside the sealing bag after the sealing bag is sealed is P2, which equals to the normal pressure P0, i.e., P2=P0>P1.

sealing, in a sealing bag in a normal pressure, the cartridge that has been injected with hot E-liquid in a normal pressure environment and the hot E-liquid has cooled down. The pressure inside the sealing bag after the sealing bag is sealed is P2, which is equal to the normal pressure P0, i.e., P2=P0>P1.

When the sealing bag and the cartridge need to couple tightly, in step c, the cartridge in which a negative pressure has formed inside the E-liquid storage tank of the cartridge is sealed in the sealing bag. The tight sealing may be realized by selecting a sealing bag having a suitable size and vacuuming the sealing bag in which the cartridge is placed such that the sealing bag and the cartridge are tightly coupled. The pressure outside of the sealing bag after the sealing bag has been sealed such that the cartridge and the sealing bag are tightly coupled is P2, which is equal to the normal pressure P0, i.e., P2=P0>P1.

The pressure P1 inside the E-liquid storage tank of the cartridge after the cartridge has been injected with the E-liquid through the above method is lower than the pressure P2 of the external environment external to the E-liquid storage tank, i.e., P2>P1. A relative negative pressure environment is formed between the interior of the E-liquid storage tank of the cartridge after the cartridge is injected with the E-liquid and the exterior of the E-liquid storage tank of the cartridge. In the meantime, the effect of the changes in the atmospheric pressure in the external atmosphere on the pressure inside the E-liquid storage tank of the cartridge can be reduced or even eliminated through isolation from the external atmosphere by the sealing bag. As a result, the leakage of the E-liquid caused by the changes in the atmospheric pressure can be effectively avoided. In the meantime, the following issues can be avoided: the cartridge 2 is manufactured in one place, and used in another place having a lower atmospheric pressure, which can cause the leakage of the E-liquid. Accordingly, contamination of the external environment by the E-liquid can be avoided. Furthermore, the quality of the E-liquid can be enhanced.

The present disclosure also provides a cartridge 2 of an electronic cigarette into which E-liquid can be injected based on the above-described dual seal reverse pressure differential cartridge E-liquid injection method. The cartridge 2 may include an E-liquid storage tank 21. The E-liquid inside the E-liquid storage tank 21 may have a pressure P1. The pressure P1 may satisfy P2>P1. The pressure P2 is an external pressure of an external environment external to the E-liquid storage tank of the cartridge of the electronic cigarette. The cartridge may be sealed in a sealing bag 3.

The present disclosure also provides a cartridge of an electronic cigarette into which E-liquid can be injected based on the above-described dual seal reverse pressure differential cartridge E-liquid injection method and an electronic cigarette assembly including the cartridge. The disclosed cartridge and the electronic cigarette assembly can effectively avoid the leakage of the E-liquid that may be caused by the changes in the external air pressure. In the meantime, the following issues can be avoided: the cartridge is manufactured in one place, and used in another place having a lower atmospheric pressure, which can cause the leakage of the E-liquid. As a result, the contamination of the external environment by the E-liquid can be avoided. Furthermore, the quality of the E-liquid can be enhanced.

The above described are merely some embodiments of the present disclosure, which do not limit the scope of the present disclosure. Any modification, equivalent substitution, or improvement within the spirit and principle of the present disclosure fall within the scope of protection of the present disclosure.

What is claimed is:

1. A method for injecting an E-liquid into a cartridge of an electronic cigarette, comprising:

a) selecting an E-liquid guiding body, and assembling the E-liquid guiding body with the cartridge;

wherein the cartridge includes an E-liquid storage tank configured for receiving an injection of the E-liquid, the E-liquid guiding body is configured to be in a fluidic communication with the E-liquid that is injected into the E-liquid storage tank, b) injecting the E-liquid into the E-liquid storage tank of the cartridge; and c) sealing the cartridge in a sealing bag after the injection of the E-liquid is completed, wherein, a pressure inside the E-liquid storage tank of the cartridge after the cartridge is injected with the E-liquid is P1, a pressure of an external environment external to the E-liquid storage tank of the cartridge after the cartridge is injected with the E-liquid is P2, P2>P1, that is, a negative pressure or a reverse pressure differential is formed inside the E-liquid storage tank of the cartridge relative to the pressure of the external environment external to the E-liquid storage tank of the cartridge, and wherein an anti-E-liquid-leakage coefficient ΔP1 of the E-liquid guiding body and an anti-air-resistance coefficient ΔP2 of the E-liquid guiding body satisfy the following condition: $(P2-P1)-(\Delta P2-\Delta P1)\geq\Delta P1$, such that the E-liquid guiding body absorbs, to a maximum degree, the E-liquid from the E-liquid storage tank after the cartridge has been injected with the E-liquid, while avoiding a leakage of the E-liquid in a non-operating state and maintaining a smooth E-liquid supply in an operating state.

2. The method for injecting the E-liquid into the cartridge of the electronic cigarette of claim 1, wherein there exists a sealed space between the cartridge and the sealing bag after the sealing bag is sealed, a pressure of the sealed space inside the sealing bag, which is a pressure of an external environment external to the E-liquid storage tank of the cartridge that has been sealed in the sealing bag is P2, P2>P1, which indicates that a negative pressure is formed inside the E-liquid storage tank of the cartridge relative to the sealed space in the sealing bag that is external to the E-liquid storage tank, and an elastic shrinking capability of the sealing bag is configured such that the sealing bag does not undergo a deformation greater than a predetermined deformation level when an external atmospheric pressure drops by 10-20%, and that the pressure P2 of the sealed space inside the sealing bag does not undergo a change greater than a predetermined pressure change level.

3. The method for injecting the E-liquid into the cartridge of the electronic cigarette of claim 2, wherein in the step b), the E-liquid having a normal pressure is injected into the E-liquid storage tank, wherein a pressure of the E-liquid injected into the E-liquid storage tank has the pressure P1, P1 is the normal pressure, which is the external atmospheric pressure P0, in the step c), the cartridge that has been injected with the E-liquid in a normal pressure environment is sealed in the sealing bag having a pressure higher than the normal pressure, wherein the pressure of the sealed space inside the sealing bag after the sealing bag is sealed is P2, and the sealing bag having the pressure higher than the normal pressure is realized by injecting into the sealing bag a gas having a pressure higher than the normal pressure, the pressure of the sealed space inside the sealing bag after the sealing bag is sealed is P2, P2>P1=P0, wherein the gas having the pressure higher than the normal pressure is an air or an inert gas.

4. The method for injecting the E-liquid into the cartridge of the electronic cigarette of claim 2, wherein in the step b), the pressure P1 of the E-liquid injected into the E-liquid storage tank is lower than the external atmospheric pressure P0, and is lower than the pressure P2 of the sealed space of the sealing bag that is external to the E-liquid storage tank, wherein the pressure P1 is the negative pressure, thereby forming the negative pressure inside the E-liquid storage tank of the cartridge relative to the pressure P2 of the sealed space inside the sealing bag that is external to the E-liquid storage tank of the cartridge.

5. The method for injecting the E-liquid into the cartridge of the electronic cigarette of claim 4, wherein the step b) comprises: after the E-liquid is injected into the E-liquid storage tank of the cartridge in a normal pressure environment, vacuuming the E-liquid storage tank of the cartridge, wherein the pressure inside the E-liquid storage tank after the vacuuming is lower than the pressure P2 of the sealed space inside the sealing bag that is external to the E-liquid storage tank of the cartridge, and wherein the pressure P1 is the negative pressure, and the step c) comprises: sealing, in the sealing bag in the normal pressure environment, the cartridge of the electronic cigarette in which the negative pressure has been formed in the E-liquid storage tank, wherein the pressure P2 inside the sealing bag after the sealing bag is sealed is equal to the normal pressure P0, which is the external atmospheric pressure, and wherein P2=P0>P1, thereby forming the negative pressure inside the E-liquid storage tank of the cartridge relative to the pressure P2 of the sealed space inside the sealing bag that is external to the E-liquid storage tank of the cartridge.

6. The method for injecting the E-liquid into the cartridge of the electronic cigarette of claim 4, wherein the step b) comprises: injecting the E-liquid into the E-liquid storage tank of the cartridge in a negative pressure environment, wherein the pressure P1 of the E-liquid in the E-liquid storage tank of the cartridge is lower than the pressure P2 of the sealed space inside the sealing bag that is external to the E-liquid storage tank of the cartridge, and wherein P1 is the negative pressure, and the step c) comprises: sealing the cartridge of the electronic cigarette in which the negative pressure has been formed in the E-liquid storage tank in the sealing bag in a normal pressure environment, wherein the pressure P2 of the sealed space inside the sealing bag after the sealing bag is sealed is equal to a normal pressure P0, which is the external atmospheric pressure, and wherein P2=P0>P1, thereby forming the negative pressure in the E-liquid storage tank of the cartridge relative to the pressure P2 of the sealed space inside the sealing bag that is external to the E-liquid storage tank of the cartridge.

7. The method for injecting the E-liquid into the cartridge of the electronic cigarette of claim 4, wherein the step b) comprises: injecting the E-liquid that is hot and that has a normal pressure into the E-liquid storage tank, wherein, after the E-liquid cools down, the pressure P1 inside the E-liquid storage tank is lower than the pressure P2 of the sealed space inside the sealing bag that is external to the E-liquid storage tank of the cartridge, and wherein P1 is the negative pressure, and the step c) comprises: sealing, in the sealing bag in a normal pressure environment, the cartridge of the electronic cigarette in which the negative pressure has been formed in the E-liquid storage tank, wherein the pressure P2 of the sealed space inside the sealing bag after the sealing bag is sealed is equal to a normal pressure P0, which is the external atmospheric pressure and wherein P2=P0>P1, thereby forming the negative pressure inside the E-liquid storage tank of the cartridge relative to the pressure P2 of the sealed space inside the sealing bag that is external to the E-liquid storage tank of the cartridge.

8. The method for injecting the E-liquid into the cartridge of the electronic cigarette of claim 1, wherein the pressure inside the E-liquid storage tank after the E-liquid is injected is P1, P1 is a negative pressure lower than a normal pressure, which is an external atmospheric pressure P0, in the step c), the cartridge in which the negative pressure has been formed in the E-liquid storage tank of the cartridge is sealed in the sealing bag that is tightly coupled with the cartridge, and after the sealing bag is sealed, a pressure of an environment external to the tightly coupled sealing bag is P2, which is equal to the normal pressure P0, wherein P2=P0>P1, thereby forming the negative pressure inside the E-liquid storage tank of the cartridge relative to the pressure P2 of the external environment external to the E-liquid storage tank, which is equal to the external atmospheric pressure P0 of an external atmosphere external to the sealing bag that is tightly coupled with the cartridge.

9. The method for injecting the E-liquid into the cartridge of the electronic cigarette of claim 8, wherein in the step c), the sealing bag that is tightly coupled with the cartridge is formed by selecting a sealing bag having a predetermined size, and vacuuming the sealing bag with the cartridge disposed therein such that the sealing bag and the cartridge are tightly closed and sealed.

10. A cartridge of an electronic cigarette, comprising:

an E-liquid guiding body;

an E-liquid storage tank configured to receive an injection of an E-liquid, wherein the E-liquid guiding body is configured to be in fluidic communication with the E-liquid injected into the E-liquid storage tank, and a sealing bag configured to seal the cartridge inside the sealing bag, wherein, the pressure of the E-liquid in the E-liquid storage tank of the cartridge after the injection of the E-liquid is P1, a pressure of an external environment external to the E-liquid storage tank of the cartridge after the injection of the E-liquid is P2, P2>P1, which indicates that a negative pressure, which is a reverse pressure differential, is formed inside the E-liquid storage tank of the cartridge relative to the pressure of the external environment external to the E-liquid storage tank of the cartridge, wherein an anti-E-liquid-leakage coefficient $\Delta P1$ of the E-liquid guiding body and an anti-air-resistance coefficient $\Delta P2$ of the E-liquid guiding body satisfy $P2-P1)-(\Delta P2-\Delta P1)\geq\Delta P1$, such that after the cartridge is injected with the E-liquid, the E-liquid guiding body absorbs, to a maximum degree, the E-liquid stored in the E-liquid storage tank, an leakage of the E-liquid in a non-operating state is avoided and a smooth supply of the E-liquid is provided in an operating state.

11. The cartridge of the electronic cigarette of claim 10, further comprising:

a base, wherein an air inlet is provided in the base of the cartridge; and an upper portion, wherein an air outlet is provided at the upper portion of the cartridge, and wherein the air inlet and the air outlet are connected by a vapor channel, a liquid inlet is provided in a side wall of the vapor channel, the liquid inlet is connected with the E-liquid storage tank, an atomizing core is provided in the vapor channel, the atomizing core includes an E-liquid guiding body and a heating element, the E-liquid guiding body is configured to absorb the E-liquid stored in the E-liquid storage tank through the liquid inlet, and the heating element is configured to atomize the E-liquid absorbed by the E-liquid guiding body.

12. The cartridge of the electronic cigarette of claim 11, further comprising:

a lower plug; and an upper plug, wherein the lower plug is configured to be assembled to the air inlet, and the upper plug is configured to be assembled to the air outlet.

13. The cartridge of the electronic cigarette of claim 12, wherein the cartridge is sealed in a sealing bag having a sealed space, a pressure of the sealed space in the sealing bag is P2, P2>P1, which indicates that the negative pressure, which is the reverse pressure differential, is formed inside the E-liquid storage tank of the cartridge relative to the pressure of the sealed space in the sealing bag that is external to the E-liquid storage tank of the cartridge.

14. The cartridge of the electronic cigarette of claim 12, wherein the cartridge is tightly sealed in a sealing bag, a pressure of an atmosphere external to the sealing bag is P2, which is a normal pressure P0, wherein P2=P0>P1, which indicates that the negative pressure, which is the reverse pressure differential is formed inside the E-liquid storage tank of the cartridge relative to the pressure of the atmosphere external to the sealing bag that is tightly sealed.

15. An electronic cigarette assembly, comprising:

at least one cartridge for an electronic cigarette that is sealed in a sealing bag, wherein the cartridge includes an E-liquid guiding body and an E-liquid storage tank configured to receive an injection of an E-liquid, wherein the E-liquid guiding body is configured to be in fluidic communication with the E-liquid injected into the E-liquid storage tank of the cartridge, wherein, a pressure inside the E-liquid storage tank of the cartridge after the E-liquid is injected is P1, a pressure of an external environment external to the E-liquid storage tank of the cartridge after the E-liquid is injected is P2, P2>P1, which indicates that a negative pressure, which is a reverse pressure differential, is formed inside the E-liquid storage tank of the cartridge relative to the pressure of the external environment external to the E-liquid storage tank of the cartridge, and wherein an anti-E-liquid-leakage coefficient $\Delta P1$ of the E-liquid guiding body and an anti-air-resistance coefficient $\Delta P2$ of the E-liquid guiding body satisfy $(P2-P1)-(\Delta P2-\Delta P1)\geq\Delta P1$, such that after the cartridge is injected with the E-liquid, the E-liquid guiding body absorbs, to a maximum degree, the E-liquid stored in the E-liquid storage tank, an leakage of the E-liquid in a non-operating state is avoided and a smooth supply of the E-liquid is provided in an operating state.

16. The electronic cigarette assembly of claim 15, further comprising:

a base, wherein an air inlet is provided in the base of the cartridge; and an upper portion, wherein an air outlet is provided at the upper portion of the cartridge, wherein the air inlet and the air outlet are connected by a vapor channel, a liquid inlet is provided in a side wall of the vapor channel, the liquid inlet is connected with the E-liquid storage tank, an atomizing core is provided in the vapor channel, the atomizing core includes an E-liquid guiding body and a heating element, the E-liquid guiding body is configured to absorb the E-liquid stored in the E-liquid storage tank through the liquid inlet, and the heating element is configured to atomize the E-liquid absorbed by the E-liquid guiding body.

17. The electronic cigarette assembly of claim 16, further comprising:

a lower plug; and an upper plug, wherein the lower plug is configured to be assembled to the air inlet, and the upper plug is configured to be assembled to the air outlet.

18. The electronic cigarette assembly of claim 17, wherein the cartridge is sealed in a sealing bag having a sealed space, a pressure of the sealed space in the sealing bag is P2, P2>P1, which indicates that the negative pressure, which is the reverse pressure differential, is formed inside the E-liquid storage tank of the cartridge relative to the pressure of the sealed space in the sealing bag that is external to the E-liquid storage tank of the cartridge.

19. The electronic cigarette assembly of claim 18, wherein the sealing bag has an elastic shrinking capability such that the sealing bag does not undergo a deformation greater than a predetermined deformation level when the external atmospheric pressure drops by 10-20%, and that a pressure P2 in a sealed space inside the sealing bag does not undergo a change greater than a predetermined pressure change level.

20. The electronic cigarette assembly of claim 17, wherein the cartridge is tightly sealed in a sealing bag, a pressure of an atmosphere external to the sealing bag is P2, which is a normal pressure P0, wherein P2=P0>P1, which indicates that the negative pressure, which is the reverse pressure differential is formed inside the E-liquid storage tank of the cartridge relative to the pressure of the atmosphere external to the sealing bag that is tightly sealed.

* * * * *